United States Patent [19]

Springer

[11] Patent Number: 4,565,533

[45] Date of Patent: Jan. 21, 1986

[54] BOAT PROPELLER GUARD

[76] Inventor: Manfred H. Springer, 6935-14th Ave., Edmonton, Alberta, Canada, T6K 3V4

[21] Appl. No.: 545,538

[22] Filed: Oct. 26, 1983

[30] Foreign Application Priority Data

Oct. 27, 1982 [CA] Canada ..... 414328

[51] Int. Cl.[4] ..... B63H 5/16

[52] U.S. Cl. ..... 440/71; 416/247 A

[58] Field of Search ..... 440/71, 72, 107; 416/247 A

[56] References Cited

U.S. PATENT DOCUMENTS

| | | | |
|---|---|---|---|
| 2,054,374 | 9/1936 | Fuller | 440/71 |
| 2,140,099 | 12/1938 | Wise | 440/71 |
| 2,319,640 | 5/1943 | Sink | 440/71 |
| 2,355,842 | 8/1944 | Arado | 440/71 |
| 2,559,179 | 7/1951 | Van Nort | 416/247 A |
| 2,597,551 | 5/1952 | Van Nort | 416/247 A |
| 3,025,825 | 3/1962 | Martinson | 440/71 |
| 3,191,203 | 6/1965 | McClay, Jr. | 440/107 |

FOREIGN PATENT DOCUMENTS

| | | |
|---|---|---|
| 401597 | 12/1941 | Canada . |
| 428446 | 7/1945 | Canada . |
| 509171 | 1/1955 | Canada . |
| 564057 | 9/1958 | Canada . |
| 849287 | 8/1970 | Canada . |
| 907421 | 8/1972 | Canada . |
| 981118 | 1/1976 | Canada . |
| 988374 | 5/1976 | Canada . |
| 1013620 | 7/1977 | Canada . |
| 1020818 | 11/1977 | Canada . |
| 1042728 | 11/1978 | Canada . |
| 1051281 | 3/1979 | Canada . |
| 1078672 | 6/1980 | Canada . |
| 1095337 | 2/1981 | Canada . |
| 1095338 | 2/1981 | Canada . |
| 1095339 | 2/1981 | Canada . |

*Primary Examiner*—Sherman D. Basinger

*Attorney, Agent, or Firm*—David A. Burge

[57] ABSTRACT

A guard for protection of an outboard motor is described. The guard comprises a main rib with a shock absorbing end portion and a resilient rib which is secured to the main rib such that, when the guard is attached to an outboard motor which is mounted on a boat and which is submerged in water, the resilient rib is disposed forward of the end portion. The forward rib and the end portion extend one behind the other in the direction of travel of the boat so that the forward rib imparts additional shock absorbing properties to the guard. Further shock absorbing resilient ribs and arcuate funnelling bands to strengthen the guard may be secured to the main rib.

4 Claims, 3 Drawing Figures

BOAT PROPELLER GUARD

BACKGROUND OF THE INVENTION

This invention relates to a guard for an outboard motor, more particularly to a guard for protecting the gear housing, fin and propeller of an outboard motor.

Outboard motors for propelling oars are often used in shallow water where water vegetation grows in profusion and where the motor is likely to hit the ground or submerged objects such as rocks, logs, etc. Guards are generally secured to an outboard motor forwardly of the propeller and are intended to reduce the possibility of damage to the propeller and adjacent parts of the motor due to striking of submerged obstacles and the possibility of weeds being drawn into and wrapped around the propeller or propeller shaft.

Various weed and propeller guards of this type are known. Several of these guards such as the guard disclosed in U.S. Pat. No. 2,054,374 to Fuller are designed to merely protect the propeller and not the fin, even though the latter is more expensive to repair than the propeller. Other known guards are not sufficiently shock absorbing to effectively protect the fin, propeller and gear housing from impact. Propellers of this kind are described in U.S. Pat. Nos. 2,140,099 to Wise; 2,355,842 to Arado; 2,319,640 to Sink and 3,025,825 to Martinson.

SUMMARY OF THE INVENTION

In this document the term "forward" means extending in the direction of travel of a boat propelled by forward drive of an outboard motor to which the inventive guard is attached and which is in its fully operational position with the motor shaft substantially perpendicular to the water surface. "Rearward" denotes the opposite direction. "Upper", "lower" and "vertical" denote directions extending substantially perpendicular to the direction of travel of the boat and generally perpendicular to the water surface.

It is one of the objects of the present invention to provide a guard adapted to be secured to an outboard motor adjacent the motor housing, propeller and fin and extending to below the fin to thus provide shock absorbing qualities which are intended to extend the life of the gear housing, the propeller and propeller shaft, and the fin by reducing the possibility of damage due to impact.

It is also an object of the invention to provide a guard useful in protecting the propeller from weeds and having attachment means connected to the guard allowing easy attachment and detachment of the guard to the motor.

Accordingly the present invention provides a guard for an outboard motor including a motor shaft, motor housing, propeller and fin. The guard comprises:

(a) elongate main rib means which have a shock absorbing resilient end portion;

(b) attachment means for securing the guard to an outboard motor such that the rib means is disposed adjacent to the motor housing and fin and the end portion extends beyond the fin and points generally rearwardly towards the propeller; and (c) at least one resilient rib fixedly secured to the main rib means such that, when the guard is attached to an outboard motor mounted on a boat and submerged in water, the resilient rib is disposed forwardly of the end portion of the main rib means and the forward resilient rib and the end portion extend one behind the other in the direction of travel of the boat, whereby the forward resilient rib imparts additional shock absorbing properties to the guard.

The main rib may, when the guard is attached to an outboard motor, extend from the motor shaft downwardly to the propeller shaft and fin. Alternatively, the resilient end portion of the main rib may extend beyond the fin. In the latter case the end portion is advantageously bent such as to generally follow the outline of the fin in spaced relation thereto and to extend substantially rearwardly to below the propeller blade so as to reduce the impact of obstacles on the fin and the propeller blades.

The attachment means may be brackets, a bracket and a sleeve or the like. Preferably, the guard is attachable to the motor in two points spaced from each other for added stability, so as to minimize any movement of the guard in relation to the motor, whether sideways or up and down. The attachment means are lined with resilient material such as rubber at the points which come into contact with the motor in order to increase the shock absorbing properties of the guard.

Generally all shock absorbing resilient ribs extend from their point of attachment to the main rib substantially downwardly and gradually rearwardly below the lowest point of the fin in spaced relation to the fin and diverging from each other in lateral direction. They may be made of steel or other resilient material.

Typically the resilient rib or ribs extending forward of the lowermost resilient rib or forward of the end portion of the main rib also extends from its point of attachment to the main rib substantially downwardly and rearwardly. The forward rib diverges from the other ribs such that in case of an obstacle being in the way of the motor the forward rib is hit first, absorbs the initial shock and, in most cases, slides over the obstacle. The other resilient ribs absorb additional shock avoiding or softening the impact on the motor. When the guard is pushed against the fin and gear housing the resilient lining of the attachment means aids in absorbing shock. If the impact is still greater the ribs will assist in lifting the motor.

As the forward rib(s) is in line with the lowermost rib(s) in the direction of travel, this rib does not increase the resistance to water to any considerable extent.

The side ribs which are secured to the main rib above the point of attachment of the resilient ribs are designed to afford protection for the propeller from weeds and submerged objects. They may be made of solid steel. Generally the side ribs extend in pairs laterally outward from the main rib. They are angled to extend, when the guard is attached to an outboard motor, in substantially rearward direction along both sides of the lower part of the motor and terminate at or near the propeller in such a way as to be spaced from the path of rotation of the propeller blade.

To give the uppermost pair of side ribs additional strength a preferred embodiment of the guard is provided with two generally arc-shaped rigid funnelling bands, each of which is fixed to a common point on the main rib which is above the point of attachment of the uppermost pair of side ribs and extends from there to the uppermost side ribs. Each of the bands is fixed to one of these two upper side ribs. The bands are advantageously made of steel and shaped such that, when the guard is in use on the motor, water flowing past the area of the band and upper side rib connection is forced toward the cooling inlet of the motor.

This effect is of advantage when the motor to which the guard is attached is tilted into a position in which the propeller is only partially submerged. Boating with the motor in half-submerged position allows the boater to enter waters only a few inches deeper than the bottom or keel of the boat. It is also used while going downstream. The idling half-submerged motor has enough power for the boater to steer away from the obstacles and is fully operational at a moment's notice as soon as it is lowered. However, since the motor is only partially submerged there is the danger of motor damage due to lack of cooling. The funnelling effect of the steel bands according to the invention increases the amount of water directed towards the cooling inlet and thus aids in cooling the motor.

BRIEF DESCRIPTION OF THE DRAWINGS

The present invention will now be described in more detail with reference to the accompanying drawings which illustrate, by way of example, a preferred embodiment of the invention and in which.

DETAILED DESCRIPTION OF THE INVENTION

Figure 1:
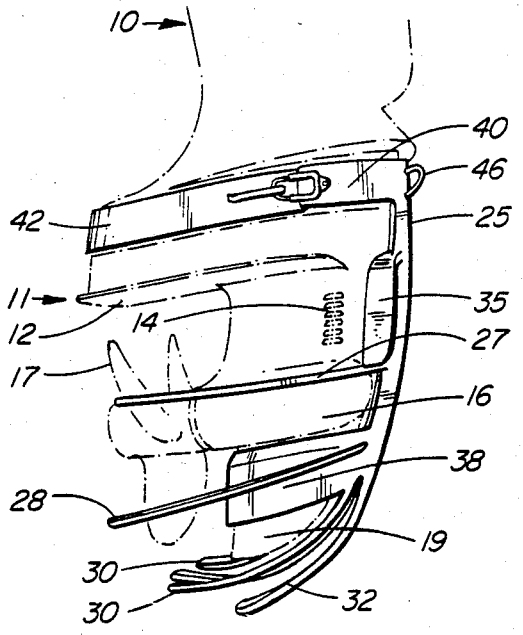
FIG. 1 is a perspective view of one embodiment of the guard attached to an outboard motor.

Referring to FIG. 1 the outboard motor shown in broken lines includes a motor shaft 10, a motor housing 11, a cavitation plate 12, cooling inlets 14, a propeller including propeller shaft 16 and propeller blade 17 and a fin 19.

Figure 2:
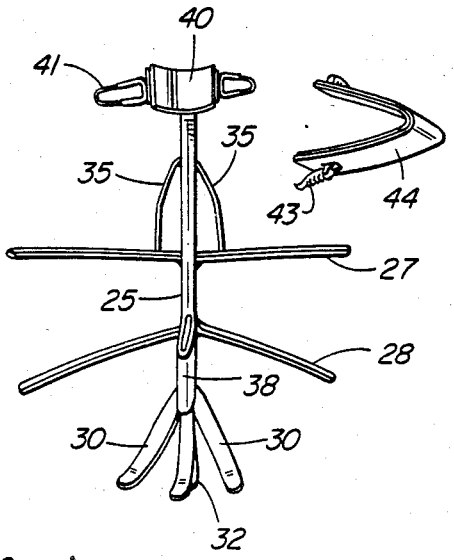
FIG. 2 is a perspective rear view of the embodiment of the guard shown in FIG. 1.
Figure 3:
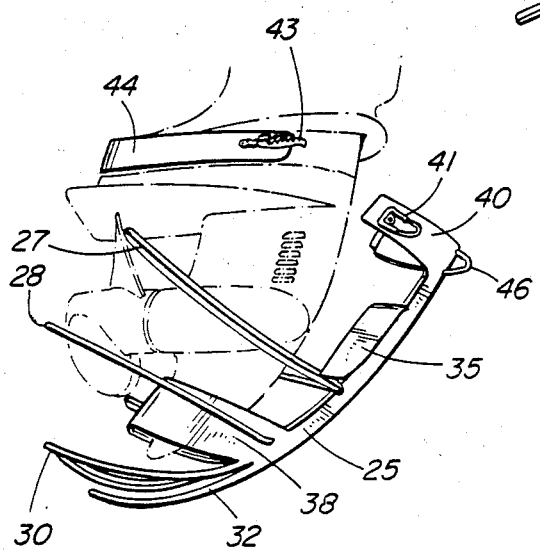
FIG. 3 is a perspective view showing the guard in the processs of being attached to a motor.

With reference to FIGS. 1 to 3 the guard according to the invention comprises a main rib 25 made of steel which, in use, extends from above the cavitation plate 12 to below fin 19. To the main rib there is secured an upper and a lower pair of side ribs 27 and 28, respectively, two shock absorbing ribs 30 and forward rib 32. The shock absorbing ribs are flat ribs attached by welding to either side of the lower end portion of the main rib. They extend, when in use, downwardly and rearwardly below fin 19 and diverge laterally from the lower end portion of the main rib.

The flat forward rib 32 is welded to the main rib directly above and forward of the point of attachment of the two shock absorbing ribs. In use, the forward rib extends downwardly below fin 19 and below the lower end portion of the main rib and ends rearwardly approximately in line with the fin. In the direction of travel the forward rib extends in front of the lower end portion of the main rib so that the resistance to water is minimized. The forward rib diverges slightly from the lower end portion of the main rib in the direction of travel. The forward rib as well as the two shock absorbing ribs are made of resilient steel.

The upper and lower pairs of side ribs 27, 28 are welded to the main rib spaced from each other and above the point of attachment of the forward rib. Each side rib extends first in lateral outward direction and then rearwardly. In use, the lower pair of side ribs 28 extend substantially below the propeller shaft 16 and the upper pair of side ribs 27 extend along the propeller shaft. Both pairs of side ribs extend slightly beyond the path of rotation of the propeller blade 17 without impeding the rotation of the propeller.

Two arcuate rigid steel funnelling ribs or bands 35 extend from a common point of attachment to the main rib above the upper pair of side ribs 27 in opposite direction laterally outwardly and downwardly to the point of attachment to the respective upper side rib. The small side of the flat bands 35 generally face in the direction of travel except that in a rearward direction the bands are directed slightly inwardly towards the cooling inlets 14 in the motor so that, in use, a funnelling effect is created directing water towards the inlet.

Between the two lower side ribs in rearward direction a lower sleeve 38 is welded to the main rib. The sleeve 38 is shaped to receive the fin 19 of an outboard motor. It is made of steel and lined with rubber.

Above the funnelling bands 35 a V-shaped bracket 40 is rigidly connected to the upper end of the main rib. The steel bracket 40 is lined with rubber and is shaped to receive a part of the motor housing above the cavitation plate 12. At either end of the bracket 40 a loop 41 is provided which is adapted to receive one of the spring biased clamps 43 which are attached to either end of a resilient metal band 44.

A safety loop 46 may be welded to the upper part of the main rib.

To mount the guard on the outboard motor the lower sleeve 38 is slid over fin 19 as shown in FIG. 3 until the sleeve fits tightly around the fin. The V-shaped bracket 40 is placed against the forward side of the motor housing above the cavitation plate. Metal band 44 is placed around the other side of the motor housing, spring biased clamps 43 are inserted into loops 41 and fastened so that bracket 40 and band 44 together snugly encircle the motor housing. Attaching as well as detaching of the guard from the motor can generally be effected in less than two minutes and without requirement of any tool.

When the guard is mounted on or removed from the outboard motor on the open water, a safety line may be attached to loop 46.

The spaced upper and lower sleeves keep the guard in place on the motor minimizing movement of the guard relative to the motor in sideways as well as in vertical direction. The rubber lining of both sleeves absorbs shocks and reduces greatly the likelihood of damage to the motor housing.

In use, the guard protects practically all parts of the motor which are submerged by avoiding or softening the impacts of rocks and other submerged obstacles on the motor, by diverging water weeds and the like from the propeller and by providing additional cooling to the motor, when the motor is used in the half-submerged position. When an obstacle is in the way of the motor it will normally be hit first by forward rib 32 which absorbs the initial shock due to its resiliency and pushes the obstacle out of the way or slides up over it. In this way the obstacle may come into contact with the lower end portion of the main rib and/or the two shock absorbing ribs which also aid in reducing the impact. If the impact is very great, the forward rib may actually be deflected to such a degree that it touches the lower end portion of the main rib and in this way provides increased rigidity. Generally, however, the ribs will cause the motor to lift up and ride over the obstacle. When on impact the guard is pushed against the fin and motor housing, the rubber lining of the upper bracket 40 and sleeve 44 and the lower sleeve 38 functions as shock absorbers. Impacts from the side are absorbed or softened by the two pairs of side ribs 27, 28 which are strengthed by funnelling bands 35. All ribs aid in diverting water vegetation.

When the motor is used in the half-submerged position, such as when the boat passes throught shallow water or down a river, the funnelling bands reduce the danger of motor damage due to insufficient cooling as these bands direct water towards the cooling inlets 14. Additionally the angulation of the various ribs of the guard causes water to flow towards the propeller providing the motor, even in the half-submerged position, with enough power to allow the boater to steer away from obstacles.

In tests performed with a guard according to the invention which was adapted to fit a 20 H.P. Mercury (Trademark) outboard motor mounted on a 12 ft. 6 in. Zodiak (Trademark) rubber boat the following was observed:

(a) the guard has little water resistance and any loss of speed due to the guard is minimal. This is attributable to the fact that the side ribs allow practically uninhibited flow of water to the propeller, as well as to the shape and arrangement of the various ribs.

(b) at higher speeds the lower end of the guard imparts a lifting effect to the boat. Again, this is due to the arrangement of the lower ribs.

In alternate embodiments of the invention more or fewer side ribs and shock absorbing ribs may be attached to the main rib, and additional forward ribs may be installed forward of the shock absorbing ribs. If the additional cooling effect and structural support of the funnel bands is not required, these may be omitted. The lower end portion of the main rib may be replaced by attaching one or more additional shock absorbing ribs to the lower end of the main rib.

Further modifications of the invention may be effected without departing from the spirit of the invention. It is intended to include all such variations which will be apparent to those skilled in the art and which fall within the scope of the claims.

I claim:

1. A guard for use with an outboard motor including a motor shaft, a motor housing, a propeller having a propeller blade, and a fin, the guard comprising:

an elongate main rib terminating in a shock-absorbing resilient end portion, attachment means for securing said rib to an outboard motor such that said main rib is disposed adjacent to and forwardly of said motor housing and fin with said rib end portion extending downwardly beyond the fin and generally rearwardly, a plurality of shock-absorbing side ribs disposed along said main rib and each having a forward end secured to said main rib and terminating in free ends extending outwardly and rearwardly on either side of said motor housing so as to be disposed on either side of said propeller, said main rib resilient end portion including a plurality of shock-absorbing lower ribs each having an upper portion secured to said main rib with the lower portions thereof extending in spaced, diverging relation downwardly and rearwardly of said fin so as to be disposed below said propeller, and, arcuate rigid funnelling ribs attached to said main rib adjacent the upper portion thereof and extending downwardly on either side thereof to define therebetween a rearwardly directed funnel opening thereby to direct water flow therethrough from said main rib toward said motor housing to enhance cooling thereof.

2. The guard of claim 1 wherein the lower ends of said funnelling ribs are attached to the uppermost side ribs respectively on either side of said main rib.

3. A guard as in claim 1 wherein the attachment means comprises a first sleeve mounted on the main rib and adapted to tightly surround the respective motor housing above the respective propeller and a second sleeve mounted on the main rib and adapted to tightly fit over the respective fin.

4. A guard as claimed in claim 3 wherein both sleeves are lined with resilient material to absorb shock and reduce damage to the respective motor.

* * * * *